United States Patent [19]

Tanaka

[11] 4,008,860

[45] Feb. 22, 1977

[54] PAPER BOBBINS

[75] Inventor: Junkichi Tanaka, Osaka, Japan

[73] Assignee: Tanaka Paper Tube Co. Ltd., Osaka, Japan

[22] Filed: Apr. 28, 1975

[21] Appl. No.: 572,213

[52] U.S. Cl. ..... 242/46.21; 242/118.32

[51] Int. Cl.[2] ..... B65H 54/54; B65H 75/10; B65H 75/30

[58] Field of Search ..... 242/46.21, 46.2, 46.3, 242/118.3, 118.31, 118.32

[56] References Cited

UNITED STATES PATENTS

| | | | |
|---|---|---|---|
| 171,577 | 12/1875 | McCausland | 242/118.32 |
| 577,736 | 2/1897 | Fisher | 242/118.32 |
| 845,575 | 2/1907 | Popplewell | 242/118.32 |
| 2,028,875 | 1/1936 | Kuwada | 242/46.2 |
| 2,381,869 | 8/1945 | Amrhein et al. | 242/118.32 |
| 2,625,335 | 1/1953 | Atwood | 242/46.21 |
| 2,751,936 | 6/1956 | Dunlap et al. | 242/118.32 X |
| 3,132,817 | 5/1964 | Atwood et al. | 242/46.21 |
| 3,248,065 | 4/1966 | Winslow | 242/46.21 |
| 3,368,767 | 2/1968 | Schmidt | 242/46.21 |

*Primary Examiner*—Stanley N. Gilreath
*Attorney, Agent, or Firm*—William C. Babcock

[57] ABSTRACT

An improved paper bobbin of such structure that it may be used on a drive spindle for a metal bobbin without alteration to the drive spindle. In the past when paper bobbins have been used, a special drive spindle was required that was not adapted to have metal bobbins mounted thereon.

3 Claims, 18 Drawing Figures

PAPER BOBBINS

BACKGROUND OF THE INVENTION

1. Field of the Invention

Paper Bobbins.

2. Description of the Prior Art

In the past, metal bobbins have been used to wind textile yarns thereon. With the wound metal bobbing being shipped to the ultimate user. The empty metal bobbins are then returned and again used as above described. A substantial time elapses between when a metal bobbin is shipped with yarn wound thereon and when the empty bobbin is returned, and as a result an excessive number of metal bobbins must be maintained in inventory. The metal bobbins are expensive, and a substantial amount of capital is tied up in having a sufficient number of metal bobbins on hand as to permit a portion of them to be out of use when they are in transit.

In an attempt to overcome this disadvantage, paper bobbins have been used. However, such paper bobbins require special or modified drive spindles that are not adapted to have metal bobbins used thereon. Paper bobbins have the advantage that they are relatively inexpensive to manufacture, and if desired may be discarded after serving their intended purpose.

A major object of the present invention is to provide an inexpensive paper bobbin that may be used on a drive spindle of the type that previously could only have metal spindles used thereon, and as a result the necessity for returning empty bobbins being eliminated.

SUMMARY OF THE INVENTION

Inexpensive paper bobbins capable of having yarn wound thereon, and the bobbins having an end structure of such design that they may be removably mounted on a drive spindle for metal bobbins, and without the necessity of altering the drive spindle.

DESCRIPTION OF THE PREFERRED EMBODIMENTS

Figure 1:
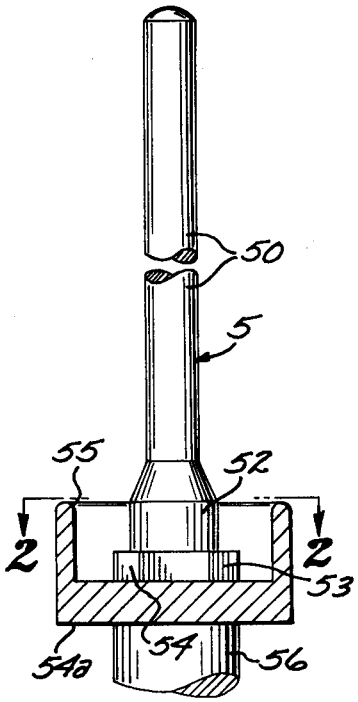
FIG. 1 PRIOR ART
FIG. 1 is a side elevational view of a conventional drive spindle for metal bobbins, with a portion thereof being shown in section.
Figure 3:
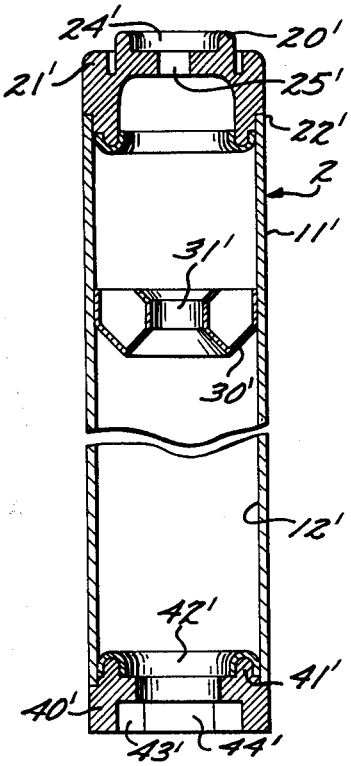
FIG. 3 PRIOR ART
FIG. 3 is a longitudinal cross-sectional view of a conventional metal bobbin removably mountable on the drive spindle shown in FIGS. 1 and 2.
Figure 2:
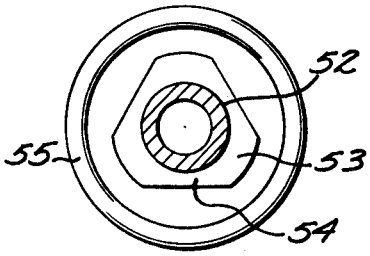
FIG. 2 PRIOR ART
FIG. 2 is a transverse cross-sectional view of the drive spindle shown in FIG. 1 taken on the line 2—2 thereof.
Figure 4:
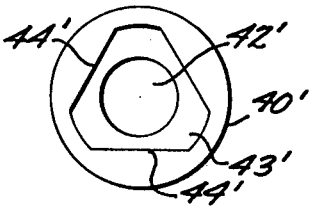
FIG. 4 PRIOR ART
FIG. 4 is a bottom plan view of the metal spindle shown in FIG. 3.

In FIGS. 1 and 2 a drive spindle 5 is shown that in the past has been used with a metal bobbin 2 of the structure shown in FIGS. 3 and 4 only. The drive spindle 5 includes an upwardly extending shaft 50, a lower fitting portion 52 of larger diameter, and a drive connection section 53. A polygonal fitting face 54 is defined on drive connection section 53. Drive connection section 53 is supported on a circular plate 54*a* that has a flange 55 extending upwardly from the periphery thereof. Plate 54*a* is mounted on the upper end of a driven rotatable member 56.

The drive spindle 5 has in the past only been usable with a metal bobbin 2 of the structure shown in FIGS. 3 and 4. The metal bobbin 2 includes a metal tubular body 11′ that is provided with an upper end cap 20′. Tubular body 11′ at substantially the center thereof supports an internal bearing 30′. The lower end of tubular body 11′ is provided with a lower end cap 40′.

Figure 6:
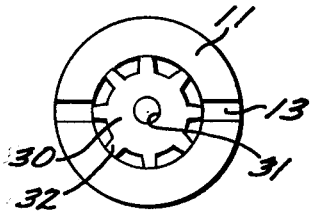
FIG. 6 PRIOR ART
FIG. 6 is a bottom plan view of a prior art paper bobbin.
Figure 7:
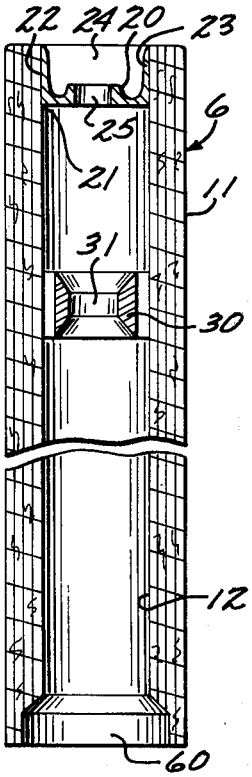
FIG. 7 is a longitudinally and partially cut sectional view of a paper bobbin according to the first embodiment of the invention.
Figure 8:
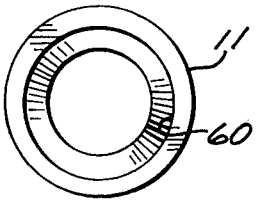
FIG. 8 is a bottom view of the paper bobbin in FIG. 7.

Upper end cap 20′ includes a base 21′, a recess 24′ formed with an annular flange on its top, an access hole 25′ in the center, and a lower extending flange 22′. Bearing 30′ is provided, and may be of a well known type, that has a hole 31′ in the center thereof to support the upper portion of the spindle 50 shown in FIG. 1. Lower end cap 40′ includes; a base 41′, an upwardly extending flange to attach to the inner face of the tubular metal body 11′, a minor fit-in hole 42′ located in the center of the base, and a major polygonal fit-in aperture 43′ coaxially aligned therewith. The inner wall of the major fit-in aperture 43′ constitutes a fitting face 44′. The metal bobbin 2 is removably mountable on the spindle drive 5 shown in FIGS. 1 and 2, when the shaft 50 engages the holes 25′ and 31′, and the fitting face 44′ is engaged in engagement with the fitting face 54 of the spindle. A first embodiment with the fitting face 54 of the spindle. A first embodiment 6 of the paper bobbins made in accordance with the present invention is shown in FIGS. 7 and 8. The paper bobbins include; a paper tubular body 11 that supports an upper end cap 20, and the body 11 at approximately the middle thereof supporting an internal bearing 30, and the lower and inner portion of the tubular body 11 being formed to define a fit-in aperture 60. The fit-in aperture 60 is formed by enlarging the bore 12 radially to fit on to drive connection section 53 shown in FIG. 1. Upper end cap 20 includes a base 21 having a cylindrical flange extending upwardly from the periphery thereof and engaging the bore 12, and the cap further including an access hole 25 in its center, and a deep recess 24. Flange 22 is provided with an exterior biased and reduced diameter portion 23. Bearing 30 is of the same general structure as shown in FIGS. 5 and 6 and which will later be described.

Accordingly, the first embodiment 6 of the paper bobbins may have shaft 50 extend into central hole 31, attaching the lower fit-in portion 52 to lower bore 12 and opposing fitting face 54 to fit-in aperture 60. Rotational power can be transferred onto paper bobbins 6 from the drive spindle 5 due to the above described engagement, and without any slip of the bobbins taking place relative to the spindle drive. In this manner, a spindle drive 5 that has previously only been used with a metal bobbin 2 may be used with a paper bobbin without alterations or modification of the drive spindle 5.

Figure 5:
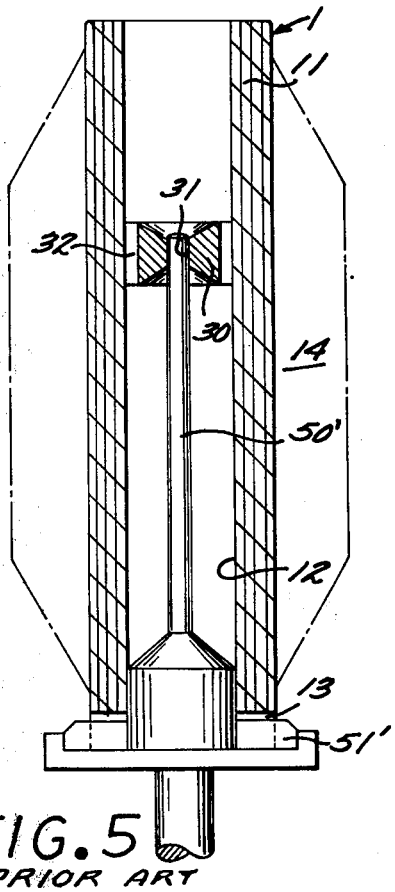
FIG. 5 PRIOR ART
FIG. 5 is a side elevational view of a drive spindle of the type that must be used with prior art paper bobbins, and one of said prior art bobbins illustrated as mounted thereon.

In the past, the only type of paper bobbin that has been used is the bobbin 1 shown in FIG. 5. The bobbin 5 includes a paper tubular body 11 that has a bore 12 extending longitudinally therethrough and a bearing 30 at substantially the center of the bobbin having an outer circumferential portion of gear-shaped configuration. A spindle shaft 50' is passed through a central bore 31 of bearing 30.

At the foot of spindle shaft 50' there are extended projections 51' to engage cut-out portions 13 at the bottom of the tubular paper body 11, which projections serve to transfer rotational movement from the spindle shaft 50' to the tubular paper body 11. The numeral 14 indicates wound yarn, the line of which yarn is indicated in phantom line. The paper bobbin 1 of the type just described, can only be used on the drive spindle 50', and not on the spindle 5 shown in FIGS. 1 and 2.

Figure 11:
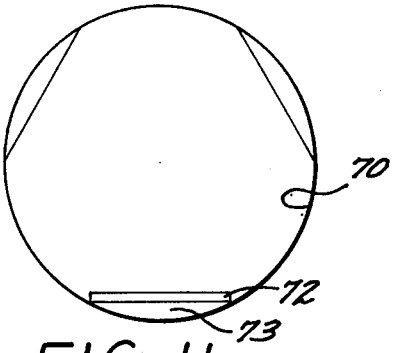
FIG. 11 is an enlarged view of a fit-in aperture of the paper bobbin in FIG. 9.
Figure 14:
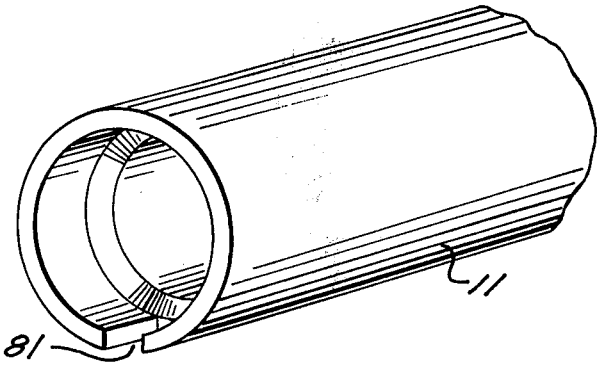
FIG. 14 is a perspective view of the lower end portion of the paper bobbin in FIG. 12.
Figure 9:
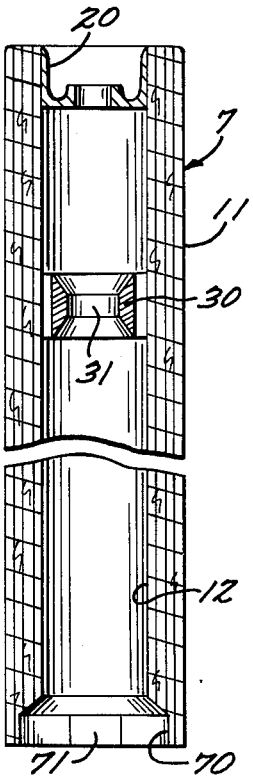
FIG. 9 is a longitudinally and partially cut sectional view of a paper bobbin according to the second embodiment of the invention.
Figure 12:
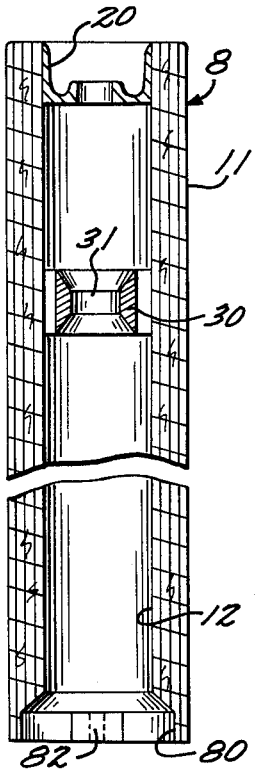
FIG. 12 is a longitudinally and partially cut sectional view of a paper bobbin according to the third embodiment of the invention.
Figure 10:
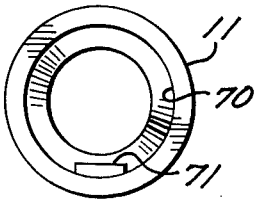
FIG. 10 is a bottom view of the paper bobbin in FIG. 9.
Figure 13:
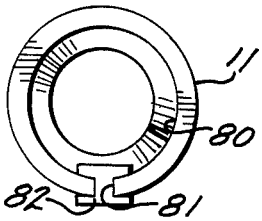
FIG. 13 is a bottom view of the paper bobbin in FIG. 12.

FIGS. 9–11 inclusive illustrate a paper bobbin 7 according to the second embodiment of this invention. The lower and inner diameter of a paper tubular body 11 is radially enlarged to provide a fit-in aperture 70 to removably engage drive connection section 53 shown in FIG. 1. The numeral 71 denotes a plug fitting provided on the inner periphery of fit-in aperture 70 to mate with drive connection section 53. This fitting 71 is made with a crescent-shaped paper or plastic piece and affixed to the inner periphery of fit-in aperture 70.

A flat fitting 72 is shown in FIG. 11 that may be used to define fitting 71. This fitting 71 may be provided in a plurality of places corresponding to fitting face 54. In the construction as defined above, spindle shaft 50 is mated with central hole 31 of bearing 30, lower fit-in portion 52 with lower bore 12, drive connection section 54 with lower fit-in aperture 70, and fittings 71 with fitting face 54 so that paper bobbin 7 can be made to revolve with security.

Figure 15:
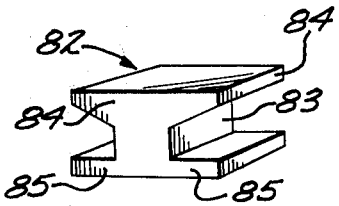
FIG. 15 is a perspective view of a fitting fastner for use of the paper bobbin in FIG. 12.

FIGS. 12–16 inclusive illustrate a paper bobbin 8 according to the third embodiment of this invention. The lower and inner diameter of a paper tubular body 11 is radially enlarged to provide a fit-in aperture 80 to removably engage connection section 53. The numeral 82 denotes a fitting fastener attached on the inner periphery of fit-in aperture 80. Fastener 82 is designed to fit on opposing face 54 of drive connection portion 53 when paper bobbin 8 is coupled to drive spindle 5 by means of shaft 50. As shown in FIG. 15, fastener 82 has an I-shaped section and a trunk portion 83 at the middle, said trunk portion being inserted across a portion 81 removed on the lower tubular wall of fit-in aperture 80, thereby jamming fastener 82 into tubular wall by means of the upper and lower cross portions 84 and 85.

Figure 16:
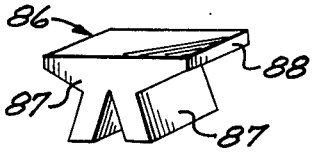
FIG. 16 is a perspective view of another fitting fastner.

FIG. 16 illustrates a fastener 86 in another form, designed not to extend over the outer periphery of paper tubular body 11. This fastener is provided with bifurcated legs 87 of an elastic nature in order to be inserted into removed portion 81. An upper bar 88 of fastener 86 is thrusted onto the inner periphery of fit-in aperture 80 to serve as fitting face. Fasteners 82 and 86 may be secured by means of adhesive. In addition, a plurality of removed portions 81 may be provided and opposed to fitting face 54 of spindle drive connection section 53 whereon fasteners 82 or 86 are contacted. In the construction as defined above, it is worked out to mate spindle shaft 50 with central hole 31 of bearing 30, lower fit-in portion with lower bore 12, and drive connection section 54 with fit-in aperture 80 while fasteners 82 or 86 are attached on fitting face 54, so that paper bobbin 8 can be driven to revolve at a high speed without slip or vibration.

Figure 17:
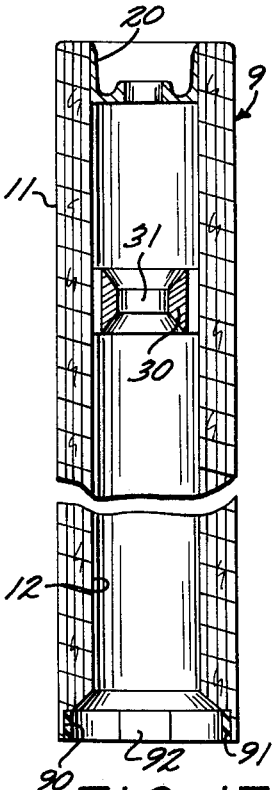
FIG. 17 is a longitudinally and partially cut sectional view of a paper bobbin according to the fourth embodiment of the invention.
Figure 18:
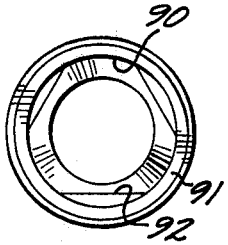
FIG. 18 is a bottom view of the paper bobbin shown in FIG. 17.

FIGS. 17 and 18 illustrate a paper bobbin 9 according to the fourth embodiment of this invention. The lower and inner diameter of paper tubular body 11 is radially enlarged to provide a fit-in aperture 90. An annular ring 91 is closely attached on the peripheral wall of fit-in aperture 90 so as to mate with spindle drive connection section 53. Annular ring 91 is made from resilient synthetic resin, or the like, and is sufficiently elastic as to be pushed into fit-in aperture 90. The numeral 92 designates a fitting portion provided on the inner periphery of ring 91 to mate with fitting face 54 of spindle drive conduction portion 53 upon coupling paper bobbin 9 with drive spindle 5, so that any slip can be prevented. In this embodiment, spindle shaft 50 mates with central hole 31 of bearing 30, lower fit-in portion 52 with lower bore 12, and drive connection section 53 with annular ring 91 whereon fitting portion 92 is attached on fitting face 54. Paper bobbin 9 can be driven at a high speed without vibration or slip.

From the above description of the paper bobbins of the present invention it will be seen that separate spindle drives for the respective paper and metal bobbins are not required, and production is carried out at considerably low cost.

I claim:

1. A discardable paper bobbin assembly for use on a metal bobbin spindle drive, which spindle drive is of the type that includes a vertically disposed shaft extending upwardly from a drive connection having a fitting face on which at least one horizontal straight surface is defined, with paper bobbin assembly includes:

a. a paper tubular body having first and second ends and an elongate longitudinal bore, said paper tubular body adjacent said second end having a cut-out portion, with said longitudinal bore being adjacent said second end and of such transverse cross section as to slidably engage said drive connection when said cut-out portion is oppositely disposed relative to said straight surface;

b. an end cap that extends into said bore adjacent said first end, with said end cap including a biased means that non-rotatably engages the interior surface of said paper tubular body;

c. an internal bearing disposed in a fixed position in said bore intermediate said first and second ends of said tubular body, with said bearing rotatably engaging said shaft when said tubular body is in engagement with said drive connection; and d. fastening means removably engaged in said cut-out portion, with said fastening means in pressure contact with said flat surface of said drive connection to prevent said paper tubular body from rotating relative to said drive connection.

2. A bobbin assembly as defined in claim 1 wherein said fastening means is a rigid body of an I shaped transverse cross section that provides a center portion disposed in said cut-out portion.

3. A bobbin assembly as defined in claim 1 wherein said fastening means is a resilient body that defines a bar and a pair of spaced, angularly disposed legs projecting therefrom, said body being disposed in said cut-out portion, with said bar being positioned in said bore in pressure contact with said straight surface and said pair of legs extending outwardly through said cut-out portion.

* * * * *